US007340878B2

(12) United States Patent
Rozenvasser et al.

(10) Patent No.: US 7,340,878 B2
(45) Date of Patent: Mar. 11, 2008

(54) METHOD OF FORMING OF JEWELRY WITH MULTIPLE LINKS

(75) Inventors: David Rozenvasser, Norwood, NJ (US); Avraham Rozenvasser, Hoboken, NJ (US)

(73) Assignee: Avraham Rozenvasser, Hoboken, NJ (US)

( * ) Notice: Subject to any disclaimer, the term of this patent is extended or adjusted under 35 U.S.C. 154(b) by 0 days.

(21) Appl. No.: 11/405,022

(22) Filed: Apr. 14, 2006

(65) Prior Publication Data

US 2006/0230740 A1 Oct. 19, 2006

Related U.S. Application Data

(60) Provisional application No. 60/671,308, filed on Apr. 14, 2005.

(51) Int. Cl.
*B21L 5/02* (2006.01)
*F16G 13/00* (2006.01)

(52) U.S. Cl. ..... 59/35.1; 59/80; 59/82

(58) Field of Classification Search ..... 59/80, 59/82, 35.1

See application file for complete search history.

(56) References Cited

U.S. PATENT DOCUMENTS 4,651,517 A * 3/1987 Benhamou et al. ..... 59/80
4,934,135 A * 6/1990 Rozenwasser ..... 59/80
5,526,639 A * 6/1996 Gonzales ..... 59/35.1
5,966,811 A * 10/1999 Zalusky ..... 29/896.4
6,223,516 B1 * 5/2001 Falcon et al. ..... 59/35.1
6,237,318 B1 * 5/2001 Kahan ..... 59/80
6,311,470 B1 * 11/2001 Rosenwasser et al. ..... 59/80
6,460,323 B1 * 10/2002 Rosenwasser et al. ..... 59/80
6,644,008 B2 * 11/2003 Rosenwasser et al. ..... 59/80
6,892,521 B2 * 5/2005 Rosenwasser et al. ..... 59/35.1

* cited by examiner

*Primary Examiner*—David B Jones
(74) *Attorney, Agent, or Firm*—Katten Muchin Rosenman LLP

(57) ABSTRACT

A method of forming a jewelry product includes forming an initial partially formed chain having a plurality of portions which are displaceable relative to one another, and a strand of wire that retains the portions together but does not limit their displacement. The initial partially formed chain is further wound around a mandrel and heated. During heating, the portions of the initial partially formed chain are being set into the shape of the mandrel while wire portions are prevented from displacing relative to one another. This final shaped spiral is then cut into individual links which are then formed into the jewelry product.

32 Claims, 5 Drawing Sheets

METHOD OF FORMING OF JEWELRY WITH MULTIPLE LINKS

CROSS-REFERENCE TO RELATED APPLICATION

This application claims priority to U.S. Provisional Application Ser. No. 60/671,308 filed on Apr. 14, 2005 and incorporated herein by reference.

BACKGROUND OF INVENTION

1. Field of the Invention

The present invention relates to jewelry chains and more particularly jewelry chains formed with multiple links secured together.

2. Discussion of Prior Art

There are numerous types of jewelry chains requiring the interconnection of links with the links thereafter being secured together. Such chains can be formed into necklaces, bracelets or other parts of jewelry. One such typical chain is the well known rope chain. With rope chains, the links are interconnected in groups and the groups are held in place by typically two wires that are wrapped around the valleys of the double helix configuration which is formed by the interconnected links. The wires hold the links in place. Thereafter the links are soldered together in selected fashion, such as soldering alternating links together. The wires are then removed and the links remain secured. The links then provide a continuous interconnected chain which is generally flexible. Such typical chain is generally described in U.S. Pat. No. 4,651,517. Other arrangements of the links are also described in U.S. Pat. No. 4,934,135. The entire contents of these patents are herein incorporated by reference. Other types of chains that are formed by interconnecting links and securing the links together are chains known as the Prima Donna Chain, Forsetina Chain, Curb Chain, Karo Chain, Byzantine Chain, Rollo Chain, Snapper Chain, or Russian Chain.

While typically such links are formed by using simple wire, it is suggested in U.S. Provisional Application Ser. No. 60/598,996, the entire content of which is herein incorporated by reference, that an initial chain be used as a "wire" to form a final chain. The method disclosed in this provisional application, by way of example, utilizes the following steps:

1. Forming a plurality of individual links 10, 12, 14 and 16, as shown in FIG. 1, using any known method which may include winding wire on a mandrel and cutting the links individually or stamping the links.

2. Interconnecting the individual links, which are not secured to one another yet, to form an initial group 18 using standard weaving techniques, a portion of which is shown in FIG. 2.

3. Wrapping iron wires 20, 22 around the double helix grooves formed by the interconnected links, as illustrated in FIG. 3.

4. Securing the interconnected links to one another by soldering every other link or other various forms of selected links at fusion points 24, thereby providing the initial actual rope chain.

5. Removing the iron wires from the initial actual rope chain, thereby completing the initial rope chain in its final form. Occasionally, the irons may not be removed. However, even if the irons are not removed, the rope chain has been completed in its final form.

6. Utilizing the initial rope chain (generally without the iron wires) to form the new jewelry chain. In the case of forming a new rope chain, the initial rope chain would now be wrapped around a mandrel. The particular mandrel can have any shape depending upon the shape of the new links that are desired to be formed. For example, a round mandrel will result in annular links; a square mandrel will result in square links.

Once the initial rope chain in its finished form is wrapped around the mandrel, since the rope chain is typically flexible, it must be set in order to retain the shape of the mandrel. As a result, usually additional solder is poured on at this point and heated to fix the shape of the wound rope chain on the mandrel to conform it to the shape of the mandrel.

7. Thereafter, cutting the wound spiral rope chain in the shape of the mandrel into individual links and assembling individual links into whatever final chain is being formed including a new rope chain or any of the previous mentioned chains.

A need, therefore, exists for a more efficient and, thus, improved method of forming a chain.

SUMMARY OF THE INVENTION

This need is met by the inventive method in which a number of steps are eliminated in order to provide a more efficient and improved process.

In accordance with a first embodiment of the invention, by way of example, individual links are interconnected to one another in a nonsecured manner allowing for displacement of the interconnected links relative to one another. Subsequently, one or more strands of wires are wrapped around the nonsecurely interconnected links to form an initially partially formed chain. However, in contrast to the known techniques, the links are not soldered together and can move relative to one another. Thus, they are simply held or retained in interconnected formation by the wires. Thereafter, this initially partially formed rope chain is wrapped around a mandrel, which may have any shape, to form a spiral. The spiral is heated and during heating the individual links are soldered together as a spiral conformed to the shape of the mandrel. Once the completed initial spiral is hardened, it assumes the form of the mandrel and can now be cut into a plurality of final individual chain links. By using solder wires to hold the initial interconnected links together the solder wire can form the solder to retain the links during heating. The final chain links can then be intertwined to form any jewelry product.

The inventive method eliminates the necessity of completely forming the initial rope chain in which individual links are secured to one another before being wrapped around a mandrel that has the desired shape of the final links. In accordance with the inventive method, nonsecurely retained individual links of the initial rope chain are fixed relative one another only after the initial partially formed rope chain is wrapped around the mandrel and then heated to assume the form of the final chain links.

In accordance with the inventive method, the securing of the initial links to each other and the contouring of the initial partially formed initial chain in conformity with the configuration of the mandrel occur simultaneously during heating the initial partially formed chain. In contrast, in the known prior art, these steps are sequential.

According to a second embodiment of the invention, the initially partially formed chain does not have individual links interconnected to one another. Instead, the initial partially formed chain is just a continuous spiral coil of wire that can be formed by simply winding a wire around an annular support, as disclosed in U.S. Pat. No. 6,892,521 the content of which is incorporated herein by reference. After removing the initial spiral coil from the support, it would normally tend to completely unwind. According to this embodiment, this coil of wire has an internal strand of wire threaded through the turns of spiral coil and fixed thereto at spaced apart locations. Fixing, for example, the opposite ends of the spiral coil to the internal strand of wire prevents the initial spiral coil from completely unwinding. However, individual turns are not secured to one another and capable of independently moving relative to one another. Thus, the initial spiral coil, like the initial rope chain configured in accordance with the first embodiment, is only partially formed. Therefore, the initial partially formed spiral coil is wound around the mandrel having the desired shape and heated. As a result, while the initial partially formed spiral coil is being set into the desired shape of the mandrel, its portions or turns are soldered together. By having the internal strand of wire as a piece of solder material, the strand is utilized for securing together the individual turns of the initial spiral chain. Furthermore, these connected turns, being wound on the mandrel takes the shape of the mandrel. Thereafter, these can be cut into the final links to form the desired chain.

Accordingly, in the present invention, inherently, the final stage of forming the initial chain being used to form the final links is completed together with the formation of the shape of the final links that can be used, in turn, to form the final chain product.

The aforementioned features and advantages of the invention will be pointed out with particularity, and will become obvious from the following detailed description of the invention, taken in conjunction with the accompanying drawings, which form an integral part thereof.

DESCRIPTION OF THE PREFERRED EMBODIMENTS

Reference will now be made in detail to several embodiments of the invention that are illustrated in the accompanying images. The images are in simplified form and are not to precise scale. For purposes of convenience and clarity only, directional terms, such as front and rear, above, and below may be used with respect to the drawings. These and similar directional terms should not be construed to limit the scope of the invention in any manner. The words "connect," "couple," and similar terms are used interchangeably and so are the words "portions," "links" and "portions," and "turns."

Figure 1:
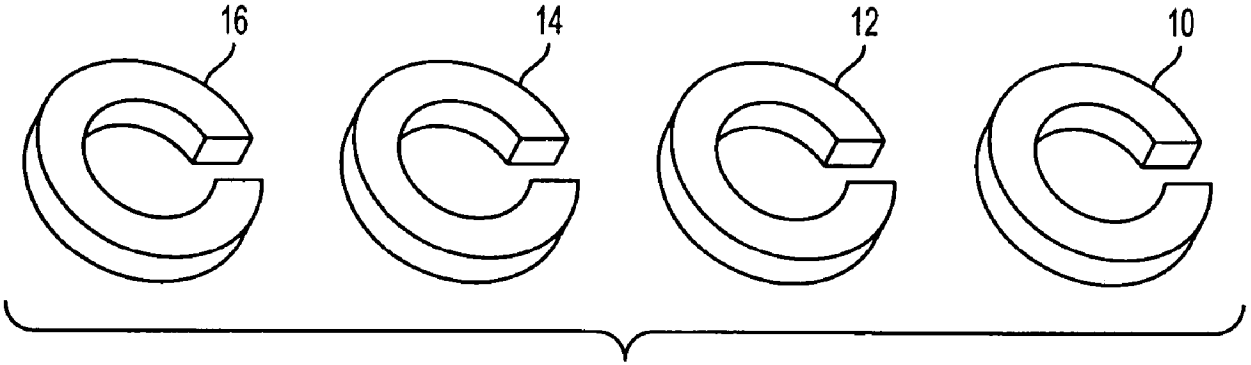
FIG. 1 PRIOR ART
FIG. 1 shows individual links.
Figure 2:
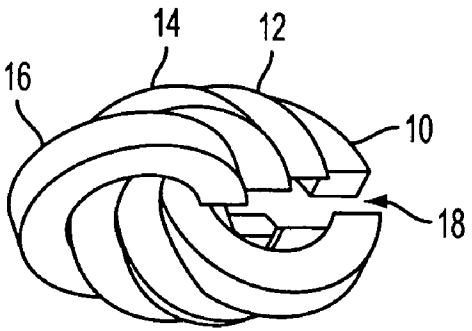
FIG. 2 PRIOR ART
FIG. 2 shows interconnected individual links of FIG. 1 interwoven to one another by standard weaving techniques.
Figure 3:
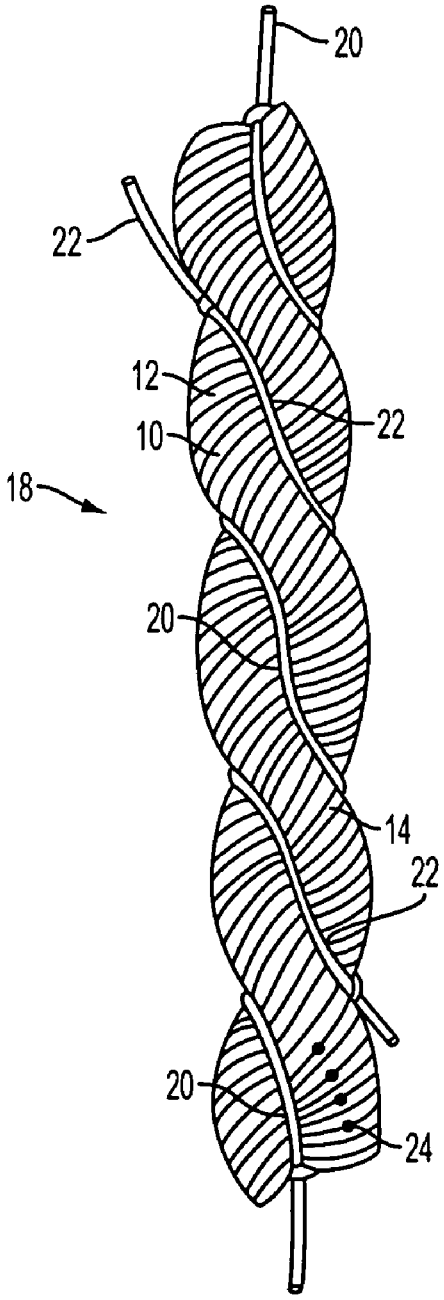
FIG. 3 PRIOR ART
FIG. 3 shows a section of interconnected individual links in the form of a rope chain and retained by strands of wire.
Figure 4:
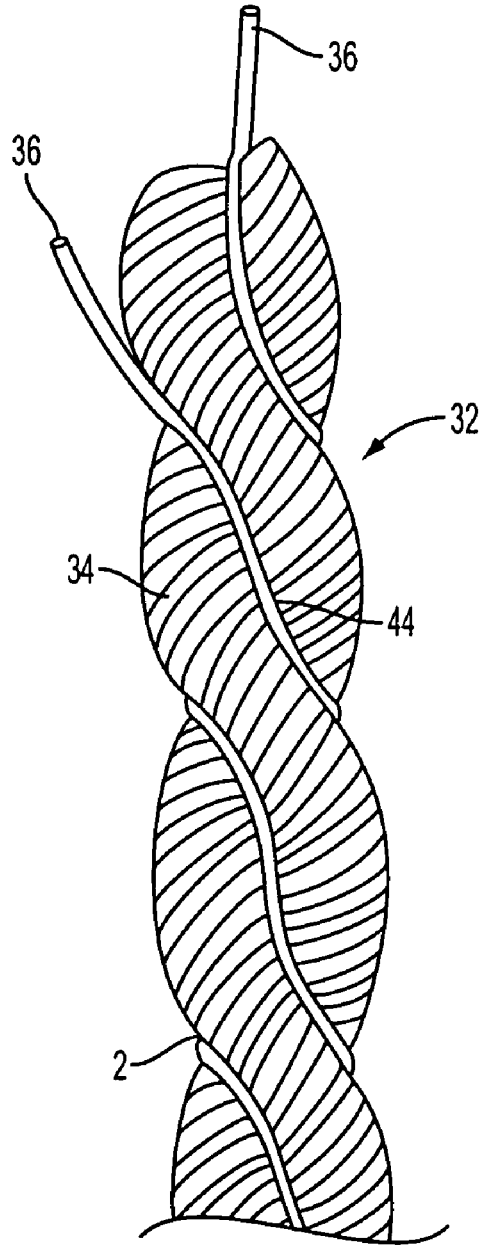
FIG. 4 shows a section of rope chain configured in accordance with the prior art.
Figure 5:
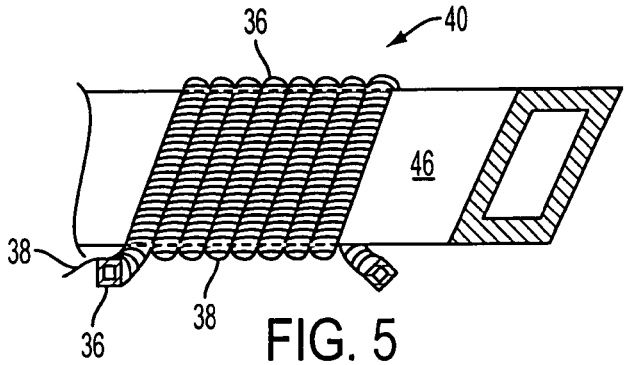
FIG. 5 shows the initially partially formed chain in accordance with a first embodiment of the present invention, wound around a square mandrel to form a spiral which then will be used to form a plurality of final individual links.

FIGS. 4 and 5 are useful in describing a first embodiment of the invention which contemplates a new method of forming a final chain product. The individual links of an initially partially formed, not yet completed rope chain, hereinafter referred to as the initial rope chain are nonsecurely retained by one or more strands of wire that, in turn, are not fixed to the links of the initial rope chain and, thus, the links are capable of displacing relative to one another. That initially partially formed chain is then wound on a mandrel and thermally treated to formulate a completed initial rope chain, which is already wound on a mandrel. The completed initial chain is thus simultaneously hardened into the shape of the mandrel and at the same time the links of the initial chain are securely coupled to one another. This spiral may then be cut into a plurality of final chain links that can be utilized to form a final chain product.

By way of example, the initially partially formed chain can be in the form of a rope chain 32, as shown in FIG. 4. The initially partially formed rope chain 32 is one that itself has interconnected links 34. The individual links 34 of initially partially formed rope chain 32 are interwoven. Any known weaving method can be utilized within the scope of the invention for forming the initially partially formed rope chain 32 which has the appearance of a double helix. In contrast to the known prior art, the interwoven links 34 of initial rope chain 32 are not secured together, but are nonsecurely or displaceably retained as interwoven links prior to their actually being completed as final links 48.

In accordance with standard rope chain techniques, one or more strands of wire 36 and 38 are wrapped around valleys 42, 44 of initially partially formed chain 32 to retain individual links 34 in a stack formation. However, the links are not secured together as with a typical rope chain. In other words, there is no rigid connection between the individual links 34 as is customarily done in the art. Instead, links 34 are simply held in place by the strands of wire in a nonsecured manner allowing links 34 to move relative to one another.

The initially partially formed rope chain 32 is then wound in a spiral fashion onto mandrel 46, as shown in FIG. 5. The shape of mandrel 46 will determine the ultimate shape of the spiral 40 and, therefore, the shape of each final individual link 48 after the final spiral is cut.

The spiral 40 is then thermally treated and simultaneously soldered while on the mandrel. In this way the spiral will harden to the shape of the mandrel, and at the same time the individual links of the initial partially formed chain are soldered together. Thus, the completed initial rope chain 32 is formulated and hardened to the shape of the mandrel and at the same time.

The wires 36 and 38 each include, among others, a gold or other precious wire, a solder wire, a combination of gold wire coated with solder, a combination of gold and solid or solder paste, a strand of gold and one of iron, a strand of gold and one of solder and combinations of any and all above. By using solder for the strands or on the strands, no additional solder need to be applied during the heating phase. Also, if precious metal is used as a strand, the strand can be left in place.

To the extent that wires 36, 38 are solder wire, such solder will melt to interconnect the initial individual links 34 to form the final chain product. If solder paste was utilized, such would again interconnect initial links 34 to form the final chain having the desired shape of mandrel 46.

To the extent an iron wire was utilized with solder paste, such iron wire would now have to be removed. However, to the extent other wire was used, such as gold, solder wire, etc. those that could remain in the valleys as it will form part of the final spiral.

Subsequently this spiral chain 40 can be cut into a plurality of final individual links that can then be used for the formation of a final chain product. These final links, however rather than being formed of individual strands of wire, are now formed of rope chain 32 which was only partially formed before being thermally treated after being wound around mandrel 46.

Similarly, wherever any other type of initial chain 32 is utilized as a "wire" to form the spiral 40 where such initial chain has individual links 34, those links are not interconnected, but simply held together in a nonsecured manner. Therefore, such initially partially formed chain 32 can be any of the well known chains having links interconnected in the form of a Primadona chain, a Rolo chain, an MX chain, a Fortzatina chain, a Karo chain, a Byzantine chain and any rope chain, and their combinations.

In sum, any of the aforementioned initially partially formed chains 32, which are formulated by links 34, which are retained in any unsecured manner, can be used in a manner corresponding to the above-disclosed embodiment of the invention. Namely, interconnected links 34 are nonsecurely held typically by means of wires 36, 38, or the like, without having the links actually secured one to the other. This, initially partially formed chain 32 is then used as a "wire" by winding it around mandrel 46 to form a spiral. Thereafter, that partially formulated chain 32 is set to the shape of the mandrel and simultaneously its individual links are interconnected with each other by heating and soldering the individual links. As a consequence, a completed initial chain is formed which, upon hardening, assumes the desired shape of a spiral wound on a mandrel. Thereafter the spiral is cut to form links which are use to form the final chain product.

By only partially forming the initial rope chain and winding it around the mandrel save a considerable number of labor steps and thereby reduces the costs. Furthermore, holding the individual links of the initial chain in place one next to the other at the same time that the final shape of the spiral is being formed to conform to the shape of the mandrel, produces an improved final chain product.

However, the initial chain that is utilized to form the final spiral and links, as disclosed in the first embodiment of the invention, need not be a chain having interconnected links. In accordance with a further embodiment of the invention, which is illustrated in FIGS. 6-9, the initially partially formed chain 50 that is utilized is a spiral coil having a plurality of turns as described in U.S. Pat. No. 6,892,521. Such spiral can be a simple spiral coil of wire having individual turns. In accordance with this embodiment of the invention, front and rear ends 56, 58, respectively, of spiral the spiral 50 are held together to prevent complete unwinding of the spiral.

Figure 6:
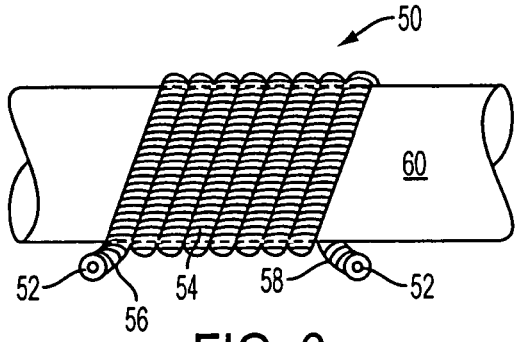
FIG. 6 shows an initially partially formed spiral wire wound around a mandrel, in accordance with the second embodiment of the present invention. The portions or turns of the initially partially formed spiral are free to move relative one another; however, the initial spiral is prevented from unraveling by an inner strand.
Figure 7:
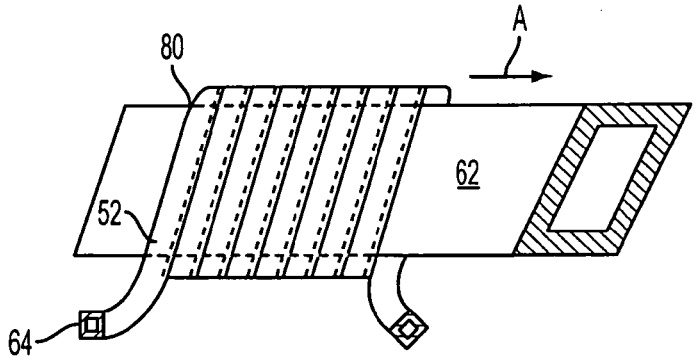
FIG. 7 shows a wire wound around a square mandrel.
Figure 10:
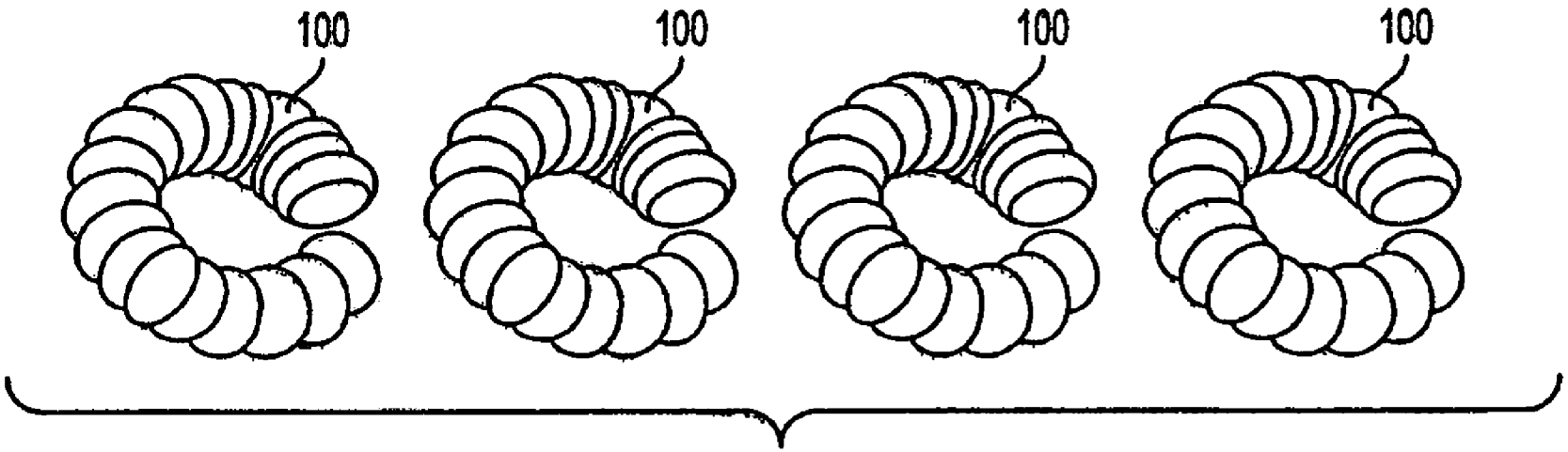
FIG. 10 shows a profile view of links formed by cutting the chain wrapped on a mandrel in FIG. 6.
Figure 11:
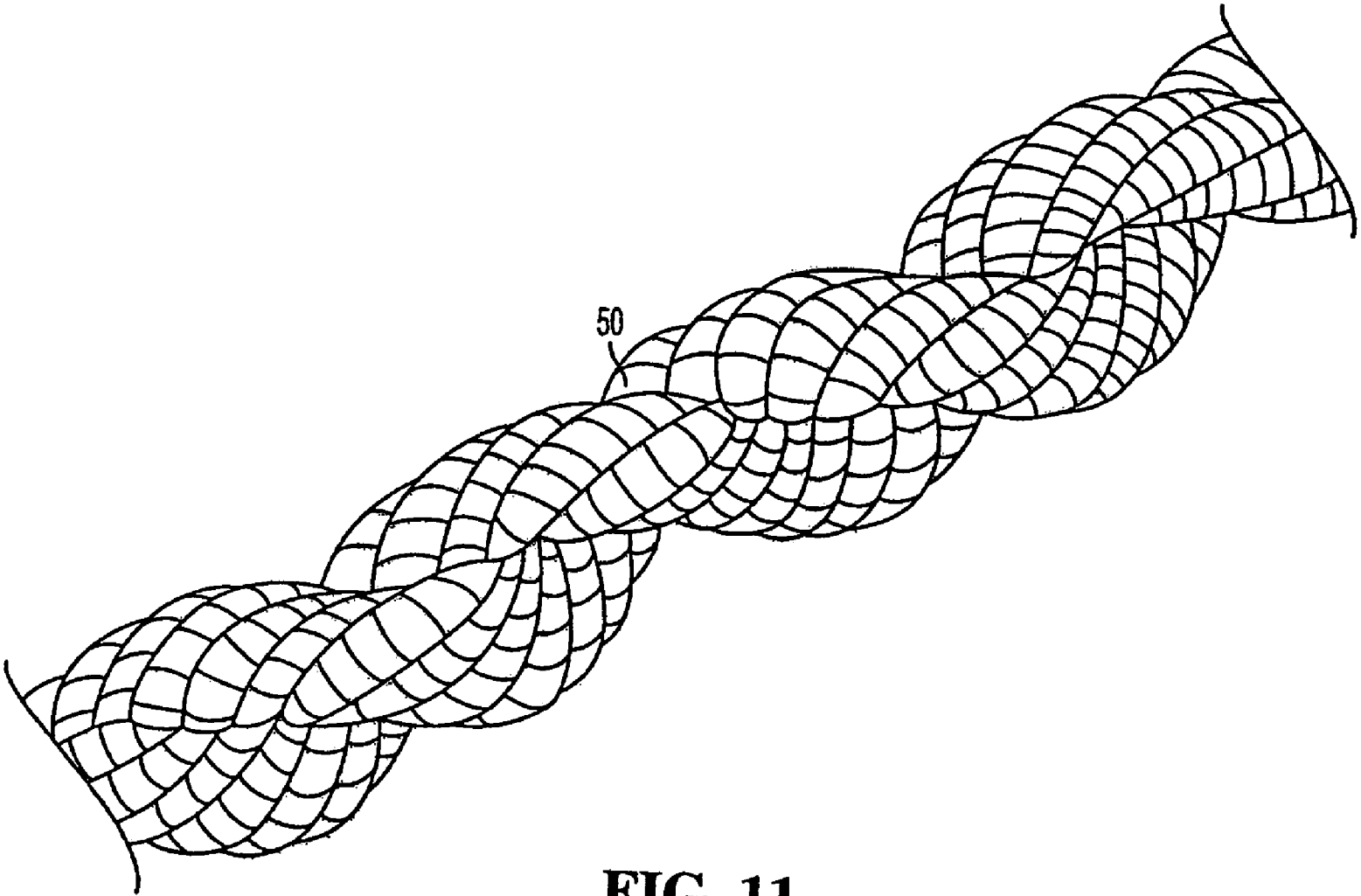
FIG. 11 shows a profile view of a final chain product formed of the links of FIG. 9.

Referring to FIG. 6, an internal strand of wire 52 is threaded through the interior of the spiral coil 50 and securely coupled at two spaced apart locations of the spiral coil 50 so as to define a spiral section having a desired length. The internal strand of wire 52 can have its opposite ends secured to front and rear ends 56, 58, respectively, of the spiral coil 50. Thus, the spiral coil 50 is prevented from total unwinding. This spiral of unconnected turns is then wound on a round mandrel 60. While on mandrel 60, it is then heated and soldered. This secures the individual turns of the coil together and simultaneously forms this spiral to conform to the shape of the mandrel. To the extent that the wire 52 is made of solder, no additional solder may be necessary. This final hardened and shaped spiral is then cut into links 100 as shown in FIG. 10 and used to form the final chain product 102, as shown in FIG. 11.

Figure 8:
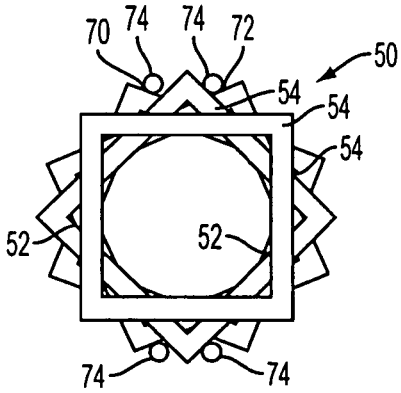
FIG. 8 shows an end view of the individual turns being skewed with respect to each other as the turns from FIG. 7 are pushed off the end of the mandrel.
Figure 9:
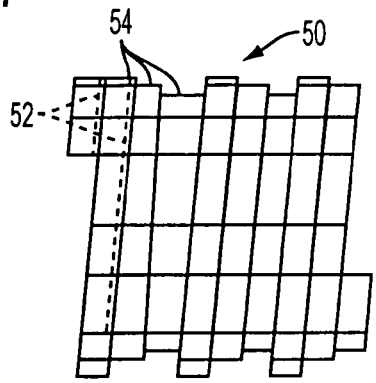
FIG. 9 is an elongated view of the spiral coil of wire with skewed individual turns as shown on FIG. 7.

While the initial coil 50 utilized in connection with FIG. 6 was a circular spiral, other types of spirals can be used as the initial coil. For example, the initial spiral can be made using square hollow wire 64 which is wound around a square mandrel, as shown in FIG. 8. As turns are formed, they can be moved off the mandrel, by way of example, in the directions shown by the arrow A in FIG. 7. As the individual turns move off the end of mandrel 60, because of the springy nature of the wire, each of the turns will slightly skew with respect to the previous turn, as shown in FIGS. 8 and 9. In this case each turn is slightly skewed from its adjacent turn.

In this case again adjacent turns are unconnected. However, in this case instead of using an internally connected wire to prevent unraveling, external wires 72, 74 can be wound within the valleys formed by the skewed turns. Furthermore, all of those type of wires described in connection with the first embodiment to hold the individual links together, can also be used around the second embodiment where valleys or groves are formed, as shown in FIGS. 8 and 9.

It should be appreciated that the initial wire that is used for either embodiment can be either solid or hollow. Furthermore, any type of cross section of the wire can be utilized to form the initial links or spirals including, square, round, triangular, oval, or any other type of configuration. Furthermore, the shape of the initial link that is being formed can also be of any type of shape including, annular, square, triangular, hexagon or any other type of shape. Also, the hollow links can either be seamed or seamless. Additionally, in the case of the first embodiment using links, these can be stamped to form the initial links.

In either embodiment the mandrel that is used to form the final links can also be of any shape. While round and square have been shown, it should be appreciated that any other shaped configurations can be used and the particular spiral or partially formed chains that are wound around such mandrel are set to the shape of such mandrel. Likewise the mandrel used for the spiral to form the final links can be of any shape.

It should also be appreciate that the links that are finally formed can be used to form any type of a chain in which links are utilized and interconnected. These include all of the chains mentioned at the beginning of the application.

The specific features described herein may be used in some embodiments, but not in others, without departure from the spirit and scope of the invention as set forth. Many additional modifications are intended in the foregoing disclosure, and it will be appreciated by those of ordinary skill in the art that in some instances some features of the invention will be employed in the absence of a corresponding use of other features. The illustrative examples therefore do not define the metes and bounds of the invention.

What is claimed is:

1. A method of forming a jewelry product comprising:

retaining a plurality of nonsecurely coupled chain portions with a strand of wire, thereby forming a partially formed chain having the plurality of nonsecurely coupled chain portions capable of displacing relative to one another;

winding the partially formed chain around a mandrel;

thermally treating the nonsecurely coupled chain portions to set the partially formed chain in a configuration of the mandrel and, simultaneously therewith, securing at least some of the plurality of chain portions so as to prevent their displacement relative to one another, to form a spiral about the mandrel and conforming to the shape of the mandrel, and cutting the spiral along the mandrel to form individual turns of the set chain which serve as links for use in forming the jewelry product.

2. The method of claim 1, further comprising forming individual chain portions each configured from a plurality of chain links and nonsecurely intertwining the chain links to form the partially formed chain, wherein the partially formed chain is an partially formed rope chain having an outward appearance of a double helix configuration, the double helix configuration having a plurality of alternating valleys and crests.

3. The method of claim 2, wherein a strand of wire is wrapped around the valleys and crests of the partially formed rope chain so as to retain the plurality of nonsecurely coupled chain links together but allow for displacement of the plurality of chain links relative to one another.

4. The method of claim 3, further comprising wrapping a second strand of wire around the partially formed rope chain without limiting displacement of the plurality of chain links relative to one another.

5. The method of claim 3, wherein the strand of wire is selected from the group consisting of a solder wire, a wire made from precious metals and an iron wire.

6. The method of claim 4, wherein the strand of wire comprises solder material and wherein thermally treating the partially formed rope chain includes melting the solder material in the valleys of the partially formed rope chain, thereby preventing displacement of the plurality of chain links relative to one another while setting the partially formed rope chain into a completely formed rope chain, while simultaneously conforming its spiral configuration to that of the mandrel.

7. The method of claim 1, further comprising selectively assembling the individual links to form the jewelry product.

8. The method of claim 1, further comprising:

wrapping a wire around a support to form a spiral having the plurality of chain portions each configured as a respective turn of the spiral, traversing the plurality of initial turns by the strand of wire, and fixing opposite ends of the strand of wire to respective spaced apart locations of the spiral so as to form the partially formed chain, the partially formed chain thereby being a spiral chain having its turns capable of displacement relative to one another.

9. The method of claim 8, wherein the strand of wire comprises solder material, and wherein thermally treating the partially formed spiral chain includes melting the solder material to the plurality of turns located between the opposite ends of the strand of wire, thereby coupling adjacent turns and simultaneously conforming its spiral configuration to that of the mandrel.

10. The method of claim 8, wherein the strand of wire is selected from the group consisting of a solder wire, a wire made from precious metals and an iron wire.

11. The method of claim 9, further comprising selectively assembling the individual links to form the jewelry product.

12. A method of forming a jewelry product comprising:

forming a plurality of first chain links;

coupling the first chain links to one another to form a plurality of nonsecurely coupled first chain links moveable relative to one another;

wrapping a strand of wire around the plurality of nonsecurely coupled first chain links so as to hold the first chain links together without limiting displacement thereof relative to one another, thereby forming an partially formed rope chain;

winding the partially formed rope chain around a mandrel;

applying heat to the wound partially formed rope chain to fix at least some of the plurality of first links relative to one another, thereby forming said first chain links into a completed rope chain, and, simultaneously therewith setting the completed rope chain to form a spiral around the mandrel in conformity with a shape of the mandrel, and cutting the spiral along the mandrel to form individual turns of said completed rope second chain for use as second chain links in forming the jewelry product.

13. The method of claim 12, further comprising winding a wire on a support and cutting the wound wire to form the plurality of first chain links, wherein the wire has a hollow or solid cross-section.

14. The method of claim 12, wherein coupling the plurality of first chain links includes intertwining the first chain links so as to provide a double helix configuration of the partially formed rope chain.

15. The method of claim 12, wherein the initially partially formed rope chain is configured as one of a Prima Dona Chain, Forsetina Chain, Curb Chain, Karo Chain, Byzantine Chain, Roll Chain, Snapper Chain and Russian Chain.

16. The method of claim 12, wherein the strand of wire is comprised of solder material and is wrapped around alternating valleys of the double helix configuration and the solder material is melted into the valleys upon applying the thermal treatment.

17. The method of claim 14, further comprising a second strand of wire wrapped around the plurality of first chain links, the strands of wire each being selected from the group consisting of a solder wire, an iron wire, a gold wire, a wire made from other precious metals, a gold wire coated with solder paste, and an iron wire coated with solder paste, wherein the strands of wire are used together in combinations of any or all of the wires of the group.

18. The method of claim 17, further comprising removing the iron strands from the completed rope chain.

19. The method of claim 12, wherein the second chain links each have one of a polygonal cross-section, round cross-section and oval cross-section.

20. The method of claim 12, wherein the first chain links each have one of a square, round, triangular and oval configuration.

21. The method of claim 12, wherein the mandrel has a shape having a circular or polygonal cross-section.

22. The method of claim 12, further comprising assembling the second chain links to form the final jewelry product.

23. A method of forming a jewelry product comprising:

wrapping a wire around a support to form a plurality of turns of a spiral of said wire;

removing the spiral from the support;

fixing opposite ends of an internal strand of wire extending through the plurality of turns to respective spaced apart locations of the wire, thereby forming a partially formed spiral chain having adjacent turns between the opposite ends of the internal strand of wire displaceable relative to one another;

winding the partially formed spiral chain around a mandrel to form a second spiral of said partially formed chain;

applying heat to the partially formed spiral chain to set the adjacent turns thereof in conformity with a shape of the mandrel while, simultaneously therewith, securing the adjacent turns so they are displaceably fixed relative to one another, thereby forming a completed spiral chain around the mandrel conforming to the shape of the mandrel, and cutting the second spiral of said chain longitudinally along the mandrel to form turns of said second spiral for use as links in forming the jewelry product.

24. The method of claim 23, wherein removing the spiral from the support includes rotating at least one turn relative to an adjacently positioned turn after removal of the at least one turn from the support.

25. The method of claim 23, wherein the support has a round outer periphery.

26. The method of claim 23, wherein the support has an outer periphery provided with one or more non-round surfaces, the spiral having a plurality of external alternating valleys and crests upon removing from the support.

27. The method of claim 23, wherein the wire has a solid cross-section or a hollow cross-section.

28. The method of claim 23, wherein the strand of wire is selected from the group consisting of a solder wire, an iron wire, a gold wire, a wire made from other precious metals, a gold wire coated with solder paste and an iron wire coated with solder paste.

29. The method of claim 26, further comprising wrapping one or more external wires around the alternating valleys of the partially formed spiral chain without securing the adjacent turns to the external wires.

30. The method of claim 23, further comprising and assembling the individual links to form the final jewelry product.

31. The method of claim 23, wherein the mandrel has a round or polygonal outer periphery.

32. A jewelry product formed in accordance with the method of claim 1.

* * * * *